US005115855A

United States Patent [19]

Lindblom et al.

[11] Patent Number: 5,115,855

[45] Date of Patent: May 26, 1992

[54] FLAT PANEL PORTABLE EXHIBIT DISPLAY AND HINGE

[75] Inventors: Curtis Lindblom, Burnsville; Michael W. Kirchner, Farmington, both of Minn.

[73] Assignee: Skyline Displays, Inc., Burnsville, Minn.

[21] Appl. No.: 609,469

[22] Filed: Nov. 5, 1990

[51] Int. Cl.[5] ..... A47G 5/00; E05D 1/00

[52] U.S. Cl. ..... 160/135; 40/605; 16/225; 16/DIG. 13

[58] Field of Search ..... 16/225, DIG. 13; 160/231.1, 231.2, 135; 40/605, 539

[56] References Cited

U.S. PATENT DOCUMENTS 2,802,522 8/1957 Collet ..... 160/231.1

3,019,486 2/1962 Stinson ..... 16/DIG. 13

FOREIGN PATENT DOCUMENTS 1033233 6/1966 United Kingdom ..... 16/DIG. 13

*Primary Examiner*—Robert L. Spruill
*Assistant Examiner*—Carmine Cuda
*Attorney, Agent, or Firm*—Palmatier & Sjoquist

[57] ABSTRACT

An improved hinge for portable multi-panel display systems, wherein the display system is formed by a plurality of individual composite panels having a cellular paperboard core the periphery of which has a relatively rigid, higher-density edging. The edging is adapted to receive either a flexible hinge for linking panels or an edge trim piece to form a finished periphery for a display system. The flexible hinge is a living hinge with two webs having parallel lines of weakness.

6 Claims, 3 Drawing Sheets

FLAT PANEL PORTABLE EXHIBIT DISPLAY AND HINGE

This invention relates generally to multi-panel display systems and, more particularly, to a hinge for panels for use in making such systems, wherein the hinge is a living hinge with webs having parallel lines of weakness.

BACKGROUND OF THE INVENTION

There are many and various methods and devices for displaying visual information. Portable easel-type frames are used to support information bearing placards or panels; panels or placards may include integral, foldable supporting frames. In the former case, the frames must be carried and erected independently from the panels comprising the display and in the latter instance, the display system may be heavy, cumbersome to carry, wasteful of space and flimsy when erected. In addition, in both cases the display system will be overly complicated to move, store and assemble.

The lightweight multi-panel display disclosed in U.S. Pat. No. 4,711,046 addresses these problems. That patent discloses a multi-panel display made up of a number of rectangular panels with a foam core. The panels are interconnected by hinges fastened into adjacent side edges of the panels.

While the multi-panel display disclosed in the above patent addresses a number of the problems with such multi-panel displays, there are some problems which have remained unaddressed. For example, improvements could be made by reducing the weight yet increasing the rigidity of the individual panels and the assembled multi-panel display system, thereby easing the erection and transportation of a display system. In an aesthetic sense, it is desirable to have a display surface which is as smooth and uniform as possible across the extent of the surface. It would also be desirable to have a display system made up of panels having a durable, rigid relatively hard periphery to enhance the durability of the individual panels and the display system into which they may be assembled. It would be advantageous if a panel for use in multi-panel displays could be made as lightweight and durable as possible without resorting to materials such as expanded foams or plastics which might be harmful to the environment.

SUMMARY OF THE INVENTION

An object of the present invention is to provide a flexible connection which may be used efficiently and inexpensively between a variety of generally planar objects such as panels.

Another object of the present invention is to provide a flexible connection or hinge device that may be used to provide a greater number and variety of possible alignments between and relative to objects which the hinge is connecting.

Yet another object of the present invention is to provide a flexible or "living" hinge which provides a smooth joint between adjacent objects, thereby providing as continuous or flat as possible a surface.

A feature of the present invention is an indeterminate length extruded thermoplastic web having a plurality of spaced parallel lines of weakness therein. A pair of the webs are combined in spaced parallel relationship to receive and be attached to a generally flat two sided object such as a panel or a partition. The flexible nature of the extruded web, in combination with the lines of weakness, allows the connected objects or panels to be positioned at any angle relative to one another.

An important advantage of the present invention is that it improves the appearance and variety of appearances which may be obtained by flat panels, particularly flat panel displays.

The invention is also of use to provide flexible joints whereby oblique corners may be easily obtained. For example, the hinge of the present invention may be used in the building construction trades to provide a smooth finished looking corner between walls or partitions which may be slightly out of plumb or misaligned.

An important use is in the flat panel display art wherein the flexible or living hinge of the present invention is juxtaposed to provide an articulating interface between two or more adjacent panels. An important advantage of the present invention when used as stated, is that the display surface or surfaces on both sides of the display will be as continuous and smooth or flat as possible across the extent of the display surface. In addition, the adjacent panels may be positioned at any angle relative to one another including a close parallel alignment for storage or transportation of the panel display.

Other objects and advantages of the present invention will become more fully understood with reference to the following specification and to the appended drawings and claims.

DESCRIPTION OF THE PREFERRED EMBODIMENT

With reference to the figures, it should be noted that the multi-panel display panel 2 of the present invention includes a plurality of panels 4 interconnected by hinges 6. The panels 4 are generally rectangular having lateral and top and bottom edges; however, the panels 4 may be configured as the user's needs dictate.

Figures 1, 5:
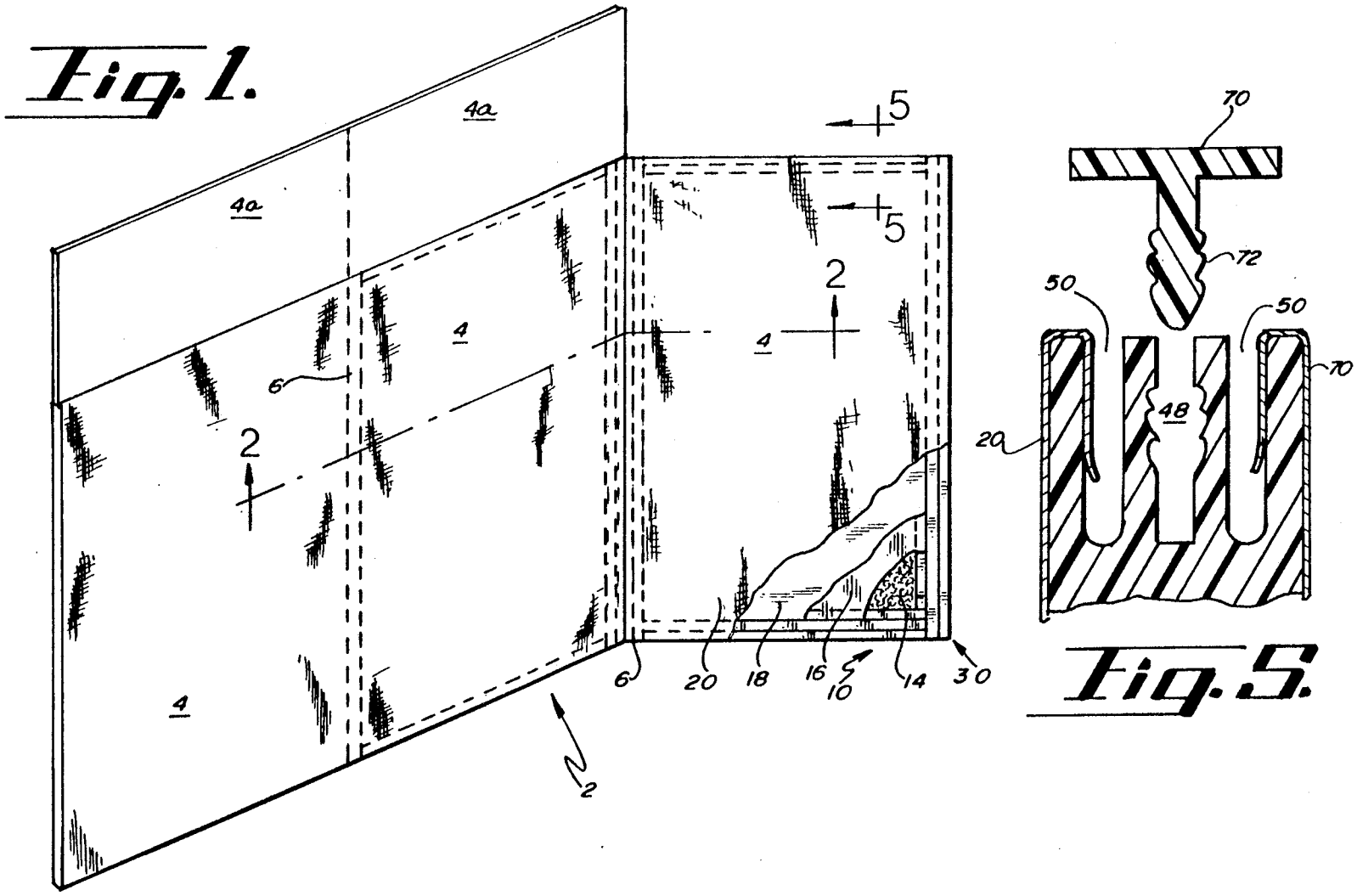
FIG. 1 is a perspective view of a multi-panel display system using the panels of the present invention, including a broken-out portion showing the layers of a panel.
FIG. 5 is a cross-section view along line 5—5 in FIG. 1 showing the trim strip for use with the present invention.

FIG. 1 shows that the panels 4 making up the multi-panel display 2 have a core 10. The core 10 has a cellular or honeycomb interior 14 which is sandwiched between walls 16. The core 10 may be formed of a paperboard or a recycled pressed paper material; however, other suitable materials may be used as well. The core 10 may be approximately one-half inch thick from the outside of one wall 16 to the outside of the other wall 16 and the closed cell cellular interior 14 may be in the range of one-quarter to three-eighths of an inch in thickness. A moisture barrier 18 is affixed to the outside of the walls 16 across the entire extent thereof. A metal foil barrier 18 is shown; however, any suitable material might be used. The display surface or overlay 20 is affixed to the foil 18. The overlay 20 comprises a fabric-like material 22 having a thin cellular material 24 beneath it and a scrim backing 26 (see FIG. 2).

Figures 2, 6:
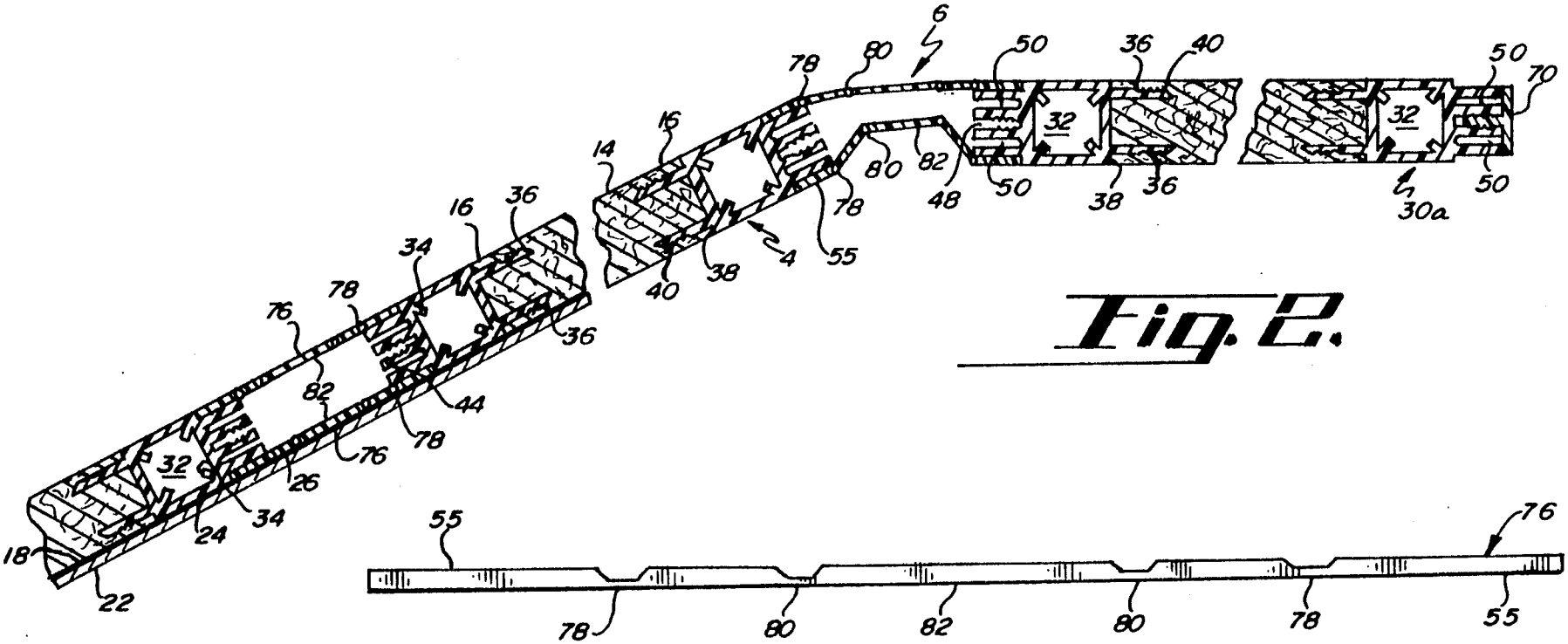
FIG. 2 is a partial, cross-section view of the present invention taken generally along line 2—2 in FIG. 1.
FIG. 6 is a detail, top plan view of one of the webs used for the hinge of the present invention.

FIG. 2 shows the panel edging or frame 30 which is used around the periphery of the panels 4. The edging 30 comprises a generally tubular center 32 which may be formed of extruded "PVC" plastic material; however, other suitable material and forming processes may be used as well. The center 32 has a number of tabs 34 extending inwardly from each corner. Two outstanding flanges 36 are provided on one side of the center 32. The flanges 36 are set inwardly toward one another to form shoulder 38. The outer surface of the flanges 36 is provided with raised areas or ribs 40 which are oblique or angled toward the center 32 (see FIG. 4).

As shown in FIG. 2, the flanges 36 of the edging 30 are designed to be placed under the walls 16 of the core 10. When so placed, the outside of the center 32 will be generally coplanar with the moisture barrier 18 to assist in forming a display surface which is as uniformly flat as possible.

FIG. 2 also shows that on the side of the center 32 opposite the side on which flanges 36 are provided, the edging 30 includes four flanges 44. The flanges 44 define and provide at least three narrow channels including central channel 48 and two outer channels 50.

Figure 4:
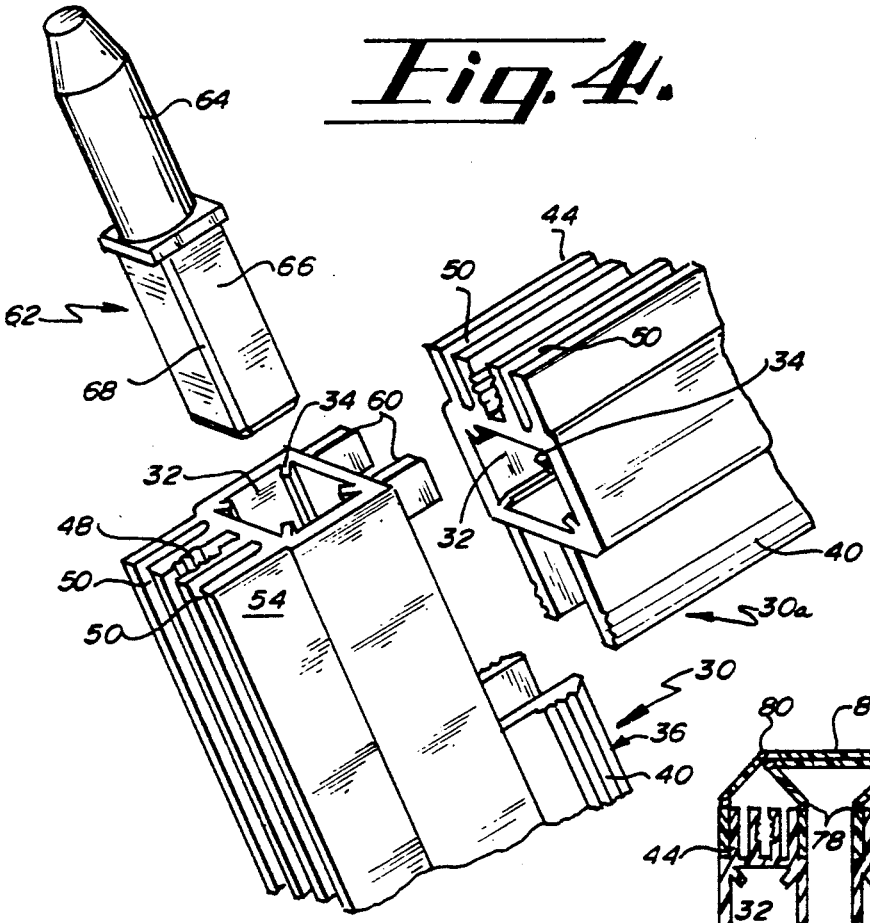
FIG. 4 is an exploded view showing a corner of a panel of the present invention.

As shown in FIGS. 4 and 5, the central channel 48 has a series of parallel depressions or troughs on the inner walls thereof. The outer channels 50 of the flanges 44 are set inwardly toward one another to form an inset or indent area 54 for receiving insert portions 55 of the hinges 6 as will be explained hereinbelow. As with the shoulder 38, the purpose of the inset space 54 is to provide a display surface as uniform as possible.

FIG. 4 shows an exploded view of how the edging 30 may be connected at the corner of a panel 4 to enhance the rigidity and durability of panel 4 and the display 2 made therefrom. Specifically, the corner comprises a mortise/tenon arrangement. The flanges 36 are cut away to leave a pair of tenons 60. The tenons 60 are received in the outer channels 50, thereby insuring proper alignment of the edging 30 at the corner and providing enhanced resistance to warping or twisting of the panel 4.

For vertically stacking the panels 4 (as shown in FIG. 1), a peg 62 is provided. The peg 62 has a cylindrical portion 64 and another portion 66 that corresponds to the configuration of the edging center 32. The corners of the polygonal portion 66 have slots 68 to accommodate the tabs 34 on the inside of the center 32.

FIG. 4 also shows that the edging 30 may have a second configuration designated **30*a* for use where a hinge 6 is not needed. Specifically, on any panel edge to which another panel 4 will not be connected, the edging 30*a* has no inset area 54, but rather extends substantially flat from the outside wall of the center 32 to the end of the flanges 44. Again, this is so the display surface is as flat and aesthetically pleasing as possible even to the edge of an individual panel 4**.

FIG. 5 shows a T-shaped trim piece 70 for use with the display panels 4 of the present invention. The base of the T has a plurality of raised areas 72 which cooperate with the depressions in the central channel 48 to form a friction lock therebetween. The outer channels 50 may receive the edges of the overlay 20 as shown, wherein the edges may be curled or turned into the channels 50 to provide an aesthetically pleasing, finished edge, further improved because the cross portion of the T-shaped trim piece 70 will cover the curled edge of the overlay 20 and the channels 50.

Figure 3:
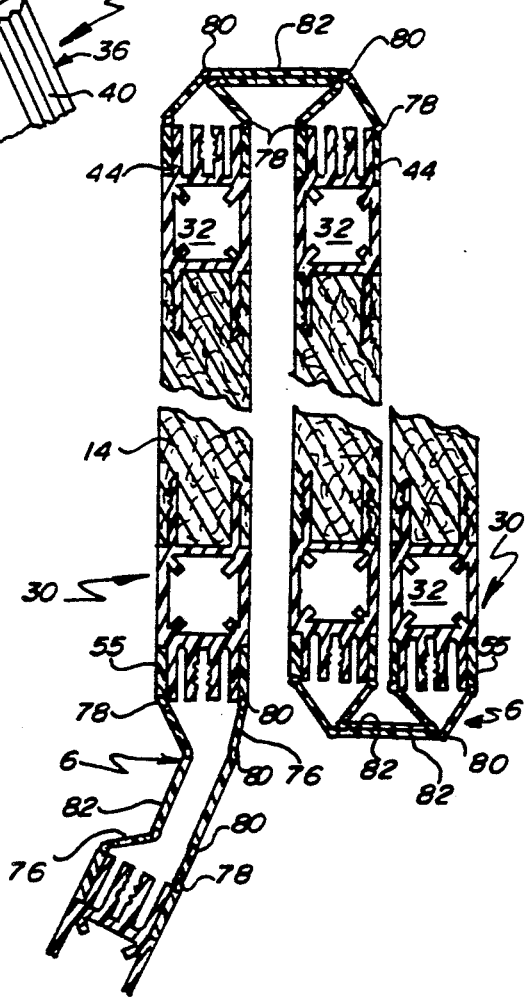
FIG. 3 is a section view showing how the hinges of the present invention permit selective folding and unfolding of the panels.

FIGS. 2 and 3 show the hinge 6 attached between the panels 4 of the present invention. The hinge 6 comprises a flexible or "living" hinge of two substantially flat flexible webs 76 having parallel pairs of lines of weakness 78, 80 therein. The two webs 76 are flexible across their entire width. The two pairs of lines of weakness 78, 80 extend the length of the hinge webs 76. They may be formed during the thermo-forming process of making the hinge webs 76 (if thermoplastic is used), by scoring or by spaced in-line perforations. One of the pairs of elongated lines of weakness 78 in the webs 76 is in approximate alignment with the edges of the flanges 44 of the edging 30. The other pair of lines of weakness 80 is disposed inwardly therefrom and a central flexible flat area 82 is provided between the inner lines 80. A side view of each hinge 6 is shown in FIG. 6.

FIGS. 2 and 3 show hinges 6 affixed along one edge of the edging 30 installed in first panel 4 and affixed along another edge of edging 30 of another panel 4. The central lines of weakness 80 are contained between and equally spaced from the edges of the edging 30. The flexibility of the hinges 6 will permit the panels 4 to open at any angle relative to each other to provide a display that may be viewed from either side.

As shown in FIG. 3, the hinges 6 may be effectively moved adjacent each other to permit the generally full closure, stacking or tight accordion-like folding of the panels 4. Note that the hinges 6 also permit the close, parallel alignment of the panels 4 with a space remaining between the surfaces of the parallel panels 4 (FIG. 3); thus, the display system may be folded with display information still in place on the front or rear surfaces of the panels 4. These advantages and positions are achieved from a single hinge 6 construction as described which may be in web form and which may be cut to size to fit particular panels 4.

In use, and to form a multi-panel display 2, the core 10 with the moisture barrier 18 in place is cut to the desired size. Next, the flanges 36 of the panel edging 30 are pushed into place between the wall 16 of the core 10. The edging 30 may be held in place by appropriate means such as adhesives or riveting; however, adhesive securing is the preferred method and the ribs 40 provided on the outside of the flanges 36 provide for a secure fit between the wall 16 and the flanges 36.

The two webs 76 comprising the hinge 6 for use between panels 4 may be put in place next. Specifically, each one of the webs 76 is affixed by an adhesive being applied to the outside of the outer flanges 44 where inset space 54 is provided and the insert portions 55 of the webs 76.

Next the overlay 20 may be applied across the extent of the multi-panel display formed by the panels 4 interconnected by the hinges 6. At the edges of the multi-panel display 2, the edges of overlay 20 may be curled into the outer channels 50 of the flanges 44 on the edging 30.

The T-shaped trim piece 70 may then be pushed into locking relationship with the central channel 48 to provide an attractive finished edge.

Finally, if a vertically stacked multi-panel display as shown in FIG. 1 is desired, peg 62 may be inserted into centers 32 to support the upper panels 4.

In the proceeding description it will be appreciated that the flat panel portable exhibit display system of the present invention maximizes the attractiveness and usefulness of the display surface itself and provides for both the convenient efficient erection, storage and transport of the display system.

As an alternative embodiment, the two webs 76 and two sections of edging 30 may be simultaneously extruded from a single mold in an extrusion process. This extrusion process may utilize a hard PVC plastic to form the extruded edgings 30, and a more flexible PVC plastic to form the webs 76. If formed in a single extruded piece, certain of the assembly steps required for the panel may be modified or eliminated.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. The combination of a "living" hinge joining and providing articulation between two adjacent members, each of said members having a front surface, a rear surface, each of the surfaces having side peripheral insets, said combination comprising:

(a) a pair of elongate strips of flexible material, each of the strips having opposing, generally parallel surfaces and opposing, generally parallel side edge insert portions, the side insert portions being affixed in the respective peripheral insets of an adjacent member such that one of the surfaces of each of the strips lies generally flush with one of the surfaces of each of the adjacent members, the strips being spaced from each other;

(b) each of the strips having a first pair of lines of weakness, each of the first lines of weakness running adjacent one of the side peripheral insets of one of the adjacent members; and (c) each of the strips having a second pair of lines of weakness, each of the second lines of weakness running parallel to each of the other lines of weakness, each of the second pair of lines of weakness adjacent to and inwardly of one of the first lines on weakness, each of the second lines of weakness being disposed equidistant from its respective adjacent first line of weakness, each of the lines of weakness being more flexible than the strip whereby the adjacent members may be hingedly connected at a multitude of angles relative to each other.

2. The combination according to claim 1, wherein said webs comprise a thermoplastic.

3. The combination according to claim 1, wherein each of said lines of weakness comprises a region of reduced thickness.

4. The combination of a "living" hinge and at least two adjacent display panels being hingedly connected by the hinge, the combination comprising:

(a) at least two adjacent display panels, each of the panels having front and rear surfaces and a periphery, each of the panels comprising:

(1) a closed cell interior panel portion with two faces;

(2) a moisture barrier skin affixed at least to the faces of the panel portion; and (3) a fabric material affixed at least over the moisture barrier skin; and (b) a hinge comprising two substantially identical parallel webs, each of the webs formed from a flexible material, one of the webs attached in insets of the periphery to the front surfaces of the panels, the other web attached in insets of the periphery to the rear surfaces of the panels, the webs spanning the space between the peripheries of the adjacent panels and being spaceable from each other, each of the webs comprising at least three parallel lines of weakness, the lines of weakness being more flexible than the webs.

5. The combination according to claim 4, wherein each of said webs comprises two pairs of parallel lines of weakness, a central pair and an outer pair, each of said webs further comprising a central flat area bounded on each side by one of the central lines of weakness, said outer lines being outside of and on either side of said central pair of lines of weakness.

6. The integrally formed combination of a "living" hinge and a pair of strips of edging for adjacent display panels, each of the panels having front and rear surfaces and a periphery, the combination comprising:

(a) a pair of strips of edging for connection to portions of the periphery which are adjacent to each other, each of the strips comprising:

(1) a tubular central piece having front and rear surfaces which define its thickness, the thickness of the piece being approximately equal to the thickness of each of the display panels;

(2) a pair of panel-penetrating flanges extending from the tubular central piece and into a portion of the periphery of one of the panels, each of the panel-penetrating flanges being set inwardly from one of the surfaces of the central tubular piece;

(3) two pairs of mortise-forming flanges extending from the tubular central piece oppositely of the panel-penetrating flanges, each of the pairs forming a mortise; and (4) a pair of tenons extending from the tubular central piece in the direction of the panel-penetrating flanges for engaging the mortise of another tubular central piece; and (b) a hinge comprising two substantially identical parallel webs, each of the webs formed from a flexible material, one of the webs attached near the front surfaces of the tubular central piece and to one of the mortise-forming flanges of each of the strips of edging, the other web attached near the rear surfaces of the tubular central piece and to one of the mortise-forming flanges of each of the strips of edging, the webs spanning the space between the mortise-forming flanges of adjacent panels and being spaceable from each other, each of the webs comprising at least three parallel lines of weakness, the lines of weakness being more flexible than the webs.

* * * * *